US009856879B2

(12) United States Patent
Casa

(10) Patent No.: US 9,856,879 B2
(45) Date of Patent: Jan. 2, 2018

(54) CENTRIFUGATION DEVICE WITH ADJUSTABLE VANES

(71) Applicant: Andritz Frautech S.r.l., Schio (IT)

(72) Inventor: Daniele Casa, Schio (IT)

(73) Assignee: Andritz Frautech S.r.l., Schio (IT)

( * ) Notice: Subject to any disclaimer, the term of this patent is extended or adjusted under 35 U.S.C. 154(b) by 581 days.

(21) Appl. No.: 14/259,610

(22) Filed: Apr. 23, 2014

(65) Prior Publication Data

US 2014/0341714 A1 Nov. 20, 2014

(30) Foreign Application Priority Data

Apr. 23, 2013 (EP) ..... 13002115

(51) Int. Cl.
*B04B 11/08* (2006.01)
*F04D 17/02* (2006.01)

(52) U.S. Cl.
CPC ..... *F04D 17/02* (2013.01); *B04B 11/082* (2013.01); *F05D 2250/52* (2013.01)

(58) Field of Classification Search
CPC ..... B04B 11/082; B64C 11/003; B64C 11/28; F01D 7/00; F04D 17/02
USPC ..... 494/57; 366/317, 326.1; 416/205, 416/87–89; 415/141
See application file for complete search history.

(56) References Cited

U.S. PATENT DOCUMENTS 195,114 A * 9/1877 Folsom ..... F03B 17/065 415/141
993,074 A * 5/1911 Kell ..... B01D 33/073 210/157
2,125,453 A * 8/1938 Lindgren ..... B04B 1/08 494/43
2,171,136 A * 8/1939 Bergner ..... B04B 1/08 494/41
2,671,635 A * 3/1954 Willi ..... F03B 3/103 415/129
2,950,686 A * 8/1960 Ledel ..... F04D 15/0055 415/141
3,565,544 A * 2/1971 Marshall ..... B63H 3/008 415/141
3,692,427 A * 9/1972 Risse ..... B01F 7/00058 415/141
4,139,330 A * 2/1979 Neal ..... F04D 29/2233 416/143

(Continued)

FOREIGN PATENT DOCUMENTS

DE 676499 C * 6/1939 ..... B04B 1/08
DE 1145102 B * 3/1963 ..... B04B 1/08

(Continued)

OTHER PUBLICATIONS

Machine translation of EP 0640398 A2.*
Machine translation of DE 4339582 C1.*

*Primary Examiner* — Charles Cooley
(74) *Attorney, Agent, or Firm* — Alix, Yale & Ristas, LLP

(57) ABSTRACT

The invention relates to a device for drawing off fluid of a centrifugation device, particularly for separating at least one fluid, with a disk (10) with channels (12, 12'). It is characterized by adjustable vanes. This allows to change the property of the disk and thus treat liquids with different properties without disassembling the separator. Therefore there is no dead time during working time and an easy adjustment of the disk.

13 Claims, 5 Drawing Sheets

(56) References Cited

U.S. PATENT DOCUMENTS 4,406,652 A * 9/1983 Nielsen ..... B04B 11/082 494/43
4,863,344 A * 9/1989 Stefanini ..... F04D 29/2283 415/141
5,171,205 A * 12/1992 Monkenbusch ..... B04B 11/082 494/10
5,217,428 A * 6/1993 Schlip ..... B04B 1/20 494/53
5,405,307 A * 4/1995 Borgstrom ..... B04B 11/082 494/57
5,779,619 A * 7/1998 Borgstrom ..... B04B 11/082 494/56
5,788,622 A * 8/1998 Borgstrom ..... B04B 11/082 494/57
6,547,519 B2 * 4/2003 deBlanc ..... F04D 29/30 415/141
6,976,948 B1 * 12/2005 Hamblad ..... B04B 1/08 494/10
7,518,864 B2 * 4/2009 Kimura ..... F04D 17/04 165/104.33
8,033,976 B2 * 10/2011 Mitchelson ..... B01D 17/0217 494/1
9,561,513 B2 * 2/2017 Mackel ..... B04B 1/14
2004/0242395 A1 * 12/2004 Thiemann ..... B04B 11/082 494/56
2005/0197241 A1 * 9/2005 Hensley ..... B04B 1/20 494/57
2007/0199907 A1 * 8/2007 Mitchelson ..... B01D 17/0217 210/782
2014/0341714 A1 * 11/2014 Casa ..... F04D 17/02 415/120

FOREIGN PATENT DOCUMENTS

DE 38 33 063 C1 10/1989
DE 4339582 C1 * 5/1995 ..... B04B 1/20
EP 0640398 A2 * 3/1995 ..... B04B 1/20
WO WO 95/29013 11/1995

* cited by examiner

CENTRIFUGATION DEVICE WITH ADJUSTABLE VANES

BACKGROUND

The invention relates to a device for drawing off fluid of a centrifugation device, particularly for separating at least one fluid, with a disk with channels.

Such disks are known as separating disks and are used mainly in centrifuges and separators to separate liquids of different densities. One kind of separating disk is described in DE 38 33 063 C1 which shows a separator with a disk and an adjustable sleeve moving in axial direction. These disks are designed for a special task, i.e. to separate specified liquids from each other. However when there are changes in the density of the liquids due to different compositions, the system does no longer operate properly. Also when different kinds of liquids have to be separated such separating disks have to be exchanged. This means that the apparatus has to be stopped and dismantled to exchange the disk with a considerable downtime of the apparatus. Another apparatus of this type is shown in WO 92/29013.

SUMMARY

The inventor now has the task to allow separating liquids properly with changing properties in a wide range but without dismantling the apparatus.

Thus the invention is characterized by the disk having adjustable vanes. This allows to change the property of the disk and thus treat liquids with different properties without disassembling the separator. Therefore there is no dead time during working time and an easy adjustment of the disk.

A further improvement is characterized by the outer diameter defined by said vanes being adjustable. This gives the advantage of always keeping the highest efficiency of separation without any compromise.

Another variant is characterized by said vanes being rotational around an axis. This will allow automating the movement by an easy increase or decrease of the external diameter of the centripetal pump.

A further development of the invention is characterized by the vanes incorporating a slot to define the movement between a minimum and maximum position of the outer diameter of said disk, where a second disk with pins protruding into the slots of said vanes may be provided. With this there is no stopping of the separator necessary during the adjustment. So the adjustment even may be done during the production.

Another improvement is characterized by a means to rotate said second disk, whereby this means may be a screw or a hydraulic or pneumatic cylinder. With such means an automation of the movement can easily be achieved.

BRIEF DESCRIPTION OF THE DRAWING

The invention is now described in more detail with reference to the accompanying drawings, where.

DETAILED DESCRIPTION

Figure 1:
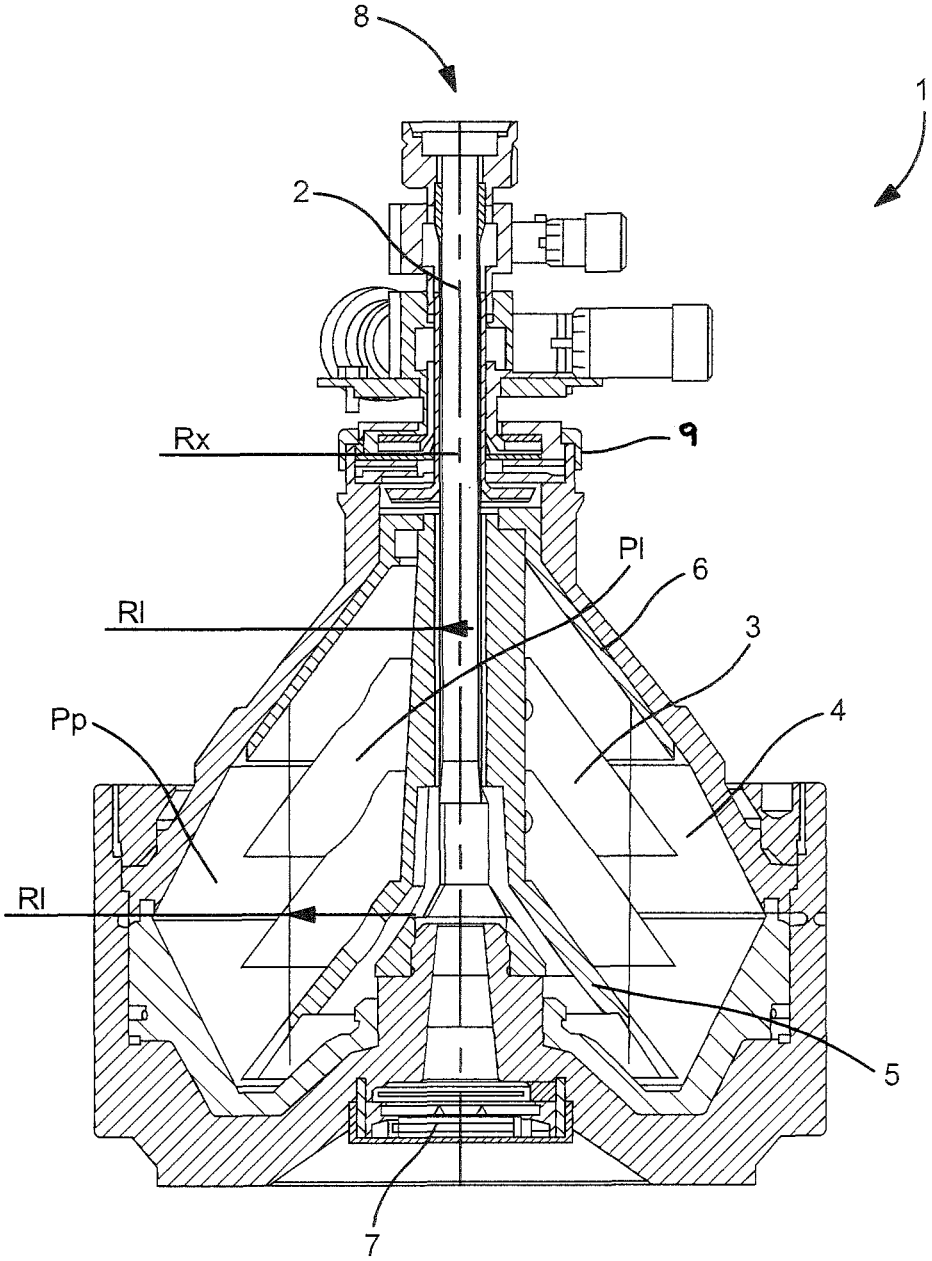
FIG. 1 shows a separator including the invention.

FIG. 1 shows a separator 1 with a rotor 2 comprising a series of conical separation disks 3 inside a separation chamber 4, a distributor 5 and a top disk 6. In the example shown in FIG. 1 the rotor 2 is mounted on a hollow shaft, through which the liquid to be centrifugally treated is supplied to the rotor. The mixture to be separated is fed into the hollow shaft on top at 8. Drive 7, which may be a belt drive, is connected to a spindle to rotate rotor 2.

The separation quality is based on the location of the liquid particles according to the following equation:

$$\rho_l(R_i-R_l)=\rho_p(R_i-R_x)$$

If the specific weight of the liquid(s) change the separation radius $R_i$ can only be changed by adapting the radius $R_x$ of the centripetal pump 9.

Here $\rho_l$ is the specific weight of the lighter phase $\rho_p$ is the specific weight of the heavier phase $R_i$ is the radius of separation $R_l$ is the inner radius of the shaft and $R_x$ is the outer radius of the centripetal pump.

With the change of $R_i$ many different kinds of products can be separated with the same separator and it may be easily modified also during operation to allow an easy setting of the separation radius for an optimal result of the separation of the liquids. Different combinations of liquids as oil and water, oil and soap, oil and gums can be separated. Also the same separator can remove water from oil in different kind of oils due to different specific weight of oil.

Figure 2:
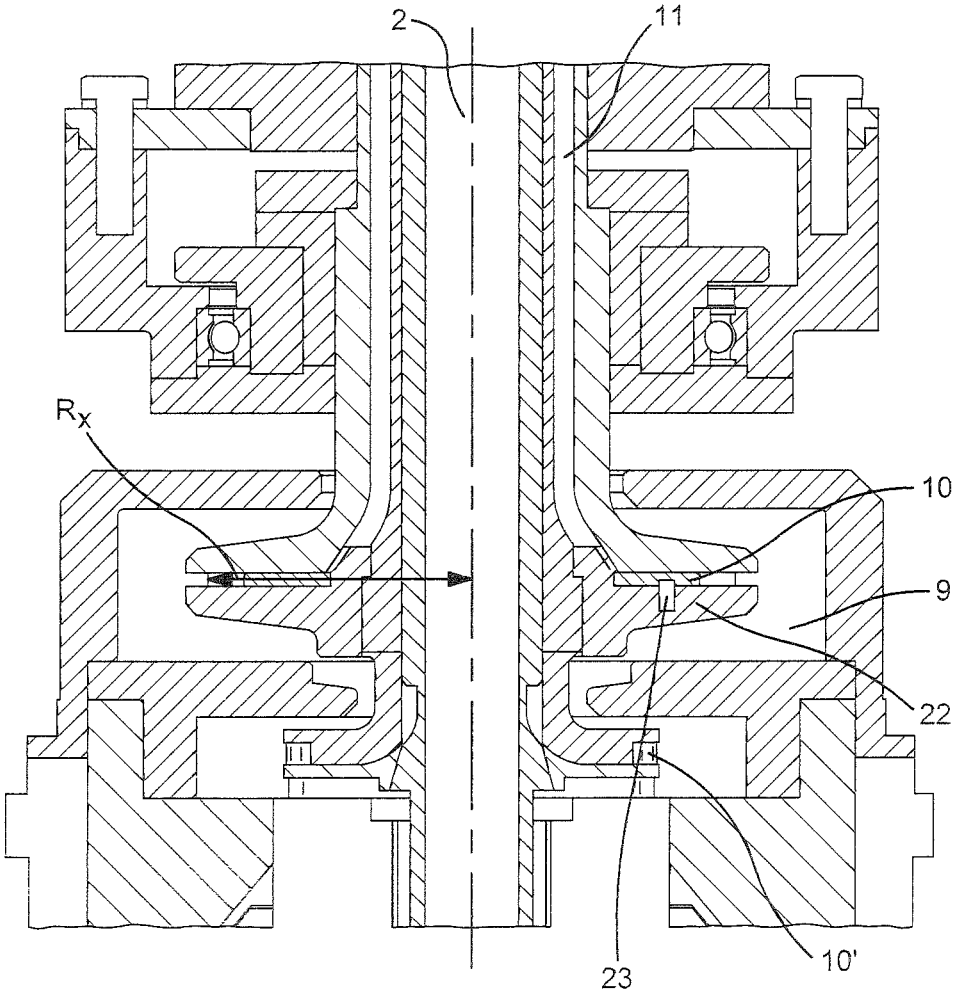
FIG. 2 shows a portion of the separator with two separating disks.

FIG. 2 shows the area of the separating disk 10, which is situated in a circular channel 9 for the discharge of one phase. The separated liquid passes through a channel 11 upward to a separate discharge. For the separation of three different liquids a second disk 10', which is not adjustable, is situated below the first adjustable separating or gravity disk 10.

Figure 3:
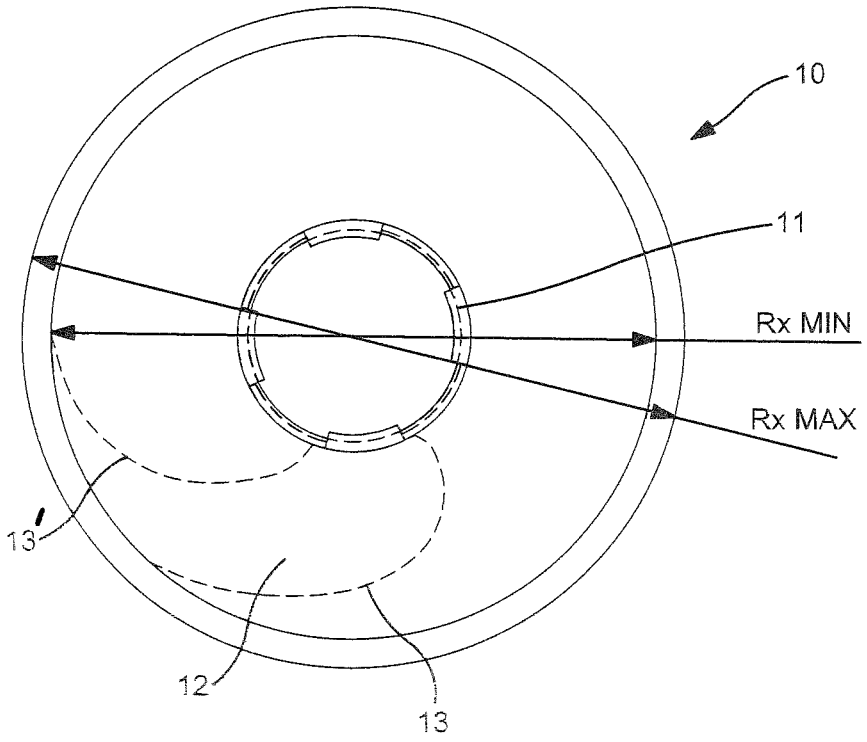
FIG. 3 shows a sketch with the different outer radii of the vanes.

FIG. 3 shows a section of the separating disk 10 with the inner channel 11. The liquid is drawn though channels 12 limited by vanes 13, 13' to the inner channel 11. In this figure the vanes 13, 13' are at the minimum position of the outer radius $R_x$ of the centripetal pump. It is also shown the maximum position of the outer radius $R_x$. It can be seen that the difference is very small, however the effect of this different position is enormous.

Figure 4:
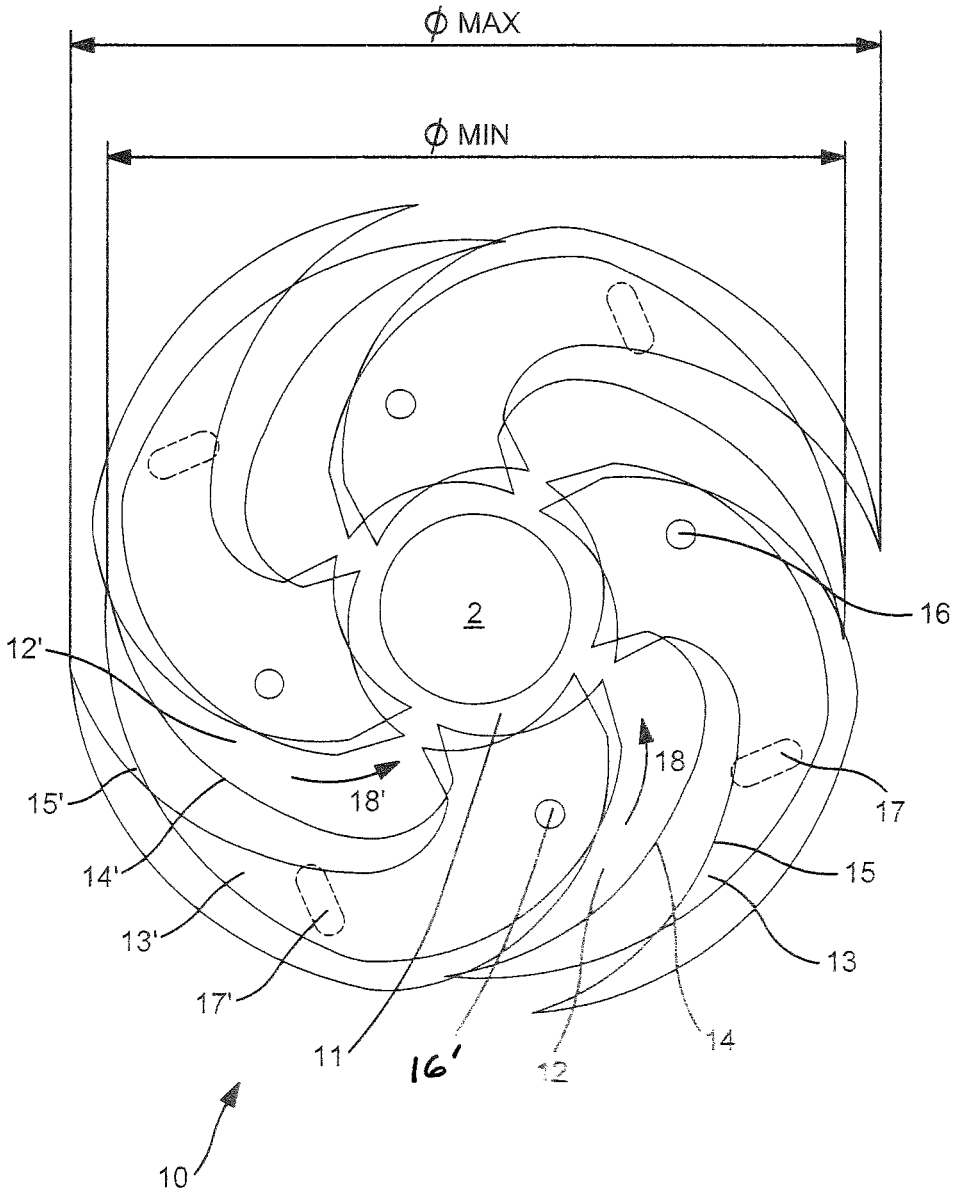
FIG. 4 shows the position of the various vanes.

In FIG. 4 the separating disk 10 is shown around the hollow rotor shaft 2 and the discharge channel 11. The lighter liquid is drawn through the channels 12, 12' in direction of the arrows 18, 18' to the discharge channel 11 and directed by the edges (in position 14, 15, 14', 15') of the vanes 12, 12'. In case of the minimum separation radius the channels 12, 12' are limited by the edges of the vanes 12, 12' in position 14, 14'. In case of the maximum separation radius the channels 12, 12' are limited by the edges of the vanes 12, 12' in position 15, 15'. The vanes 12, 12' are pivotal around axes (preferably in form of pins) 16, 16' and guided by pins fixed at a second disk in slots 17, 17' situated in the vanes 12, 12' of the separation disk 10. Thus the way of the vanes 12, 12' is defined and limited.

Figure 5:
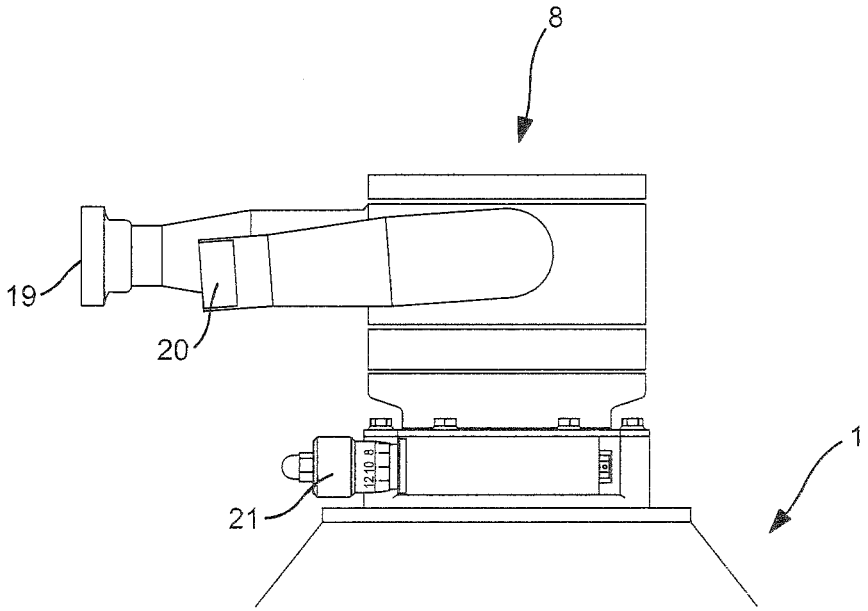
FIG. 5 shows a possible variant of the invention to adjust the vanes.

FIG. 5 shows a side view of the top of a separator 1 with the top opening 8 to feed the liquid. Further the discharge opening 19 for the lighter phase and 20 for the heavier phase can be seen. In addition screw 21 is shown with which the vanes can be moved and thus the separation radius be changed even during operation and without dismantling of any part of the separator 1.

FIG. 2 shows that a second disk 22 is situated immediately below main disk 10. The top of the second disk forms the bottom of channels 12 shown in FIG. 4. Pins 23 fixed to the second disk 22 are guided in the adjustment slots 17 of disk 10 for adjusting the outer diameter of the vanes. The pins 23 can move within slots 17 because the second disk 22 can be rotated relative to the main disk 10, by means of, e.g., screw 21.

The invention claimed is:

1. A separator with a device for separating specific liquids from each other and drawing off fluid in centrifugation separation equipment, comprising a rotor with a series of conical separation disks inside a separation chamber, a distributor, a top disk and a main separation disk defining a radius of separation with a plurality of fluid flow channels defined by a plurality of vanes that have an adjustable outer diameter.

2. The device according to claim 1, wherein each vane is rotatable about a respective axis.

3. The device of claim 1, wherein each vane includes a slot that defines a minimum and a maximum outer diameter.

4. The device of claim 3, including a second disk having a plurality of pins that respectively engage said slots in the vanes.

5. The device of claim 4, wherein said second disk is rotatable.

6. The device of claim 3, wherein a second disk is cooperatively associated with said main separation disk, said second disk has a plurality of pins respectively guided in said slots in the vanes, and said second disk is rotatable whereby said pins rotate and thereby adjust the outer diameter of said vanes.

7. A centripetal discharge pump of a centrifugal fluid phase separator, comprising:

a rotor defining pump axis, the rotor having a series of conical separation disks positioned inside a separation chamber;

a distributor;

a top disk;

a circular chamber for the discharge of one phase;

a discharge disk for separating specific liquids from each other, the disk defining a radius of separation having an inner diameter and an outer diameter, situated within the discharge chamber, coaxial with and rotated by the rotor, with a discharge channel between the inner diameter of the disk and the rotor;

wherein the discharge disk has a plurality of vanes extending from the outer diameter to the inner diameter, said vanes defining a plurality of channels running from the outside diameter to the discharge channel; and wherein the vanes have an adjustable outer diameter.

8. The centripetal discharge pump of claim 7, wherein each vane is rotatable about a respective axis.

9. The centripetal discharge pump of claim 7, wherein each vane includes a slot that defines a minimum and a maximum outer diameter.

10. The centripetal discharge pump of claim 9, including a second disk having a plurality of pins that respectively engage said slots in the vanes.

11. The centripetal discharge pump of claim 10, wherein said second disk is rotatable.

12. The centripetal discharge pump of claim 11, wherein each vane is rotatable about a respective axis.

13. The centripetal discharge pump of claim 9, wherein a second disk is cooperatively associated with said discharge disk, said second disk has a plurality of pins respectively guided in said slots in the vanes, and said second disk is rotatable whereby said pins rotate and thereby adjust the outer diameter of said vanes.

* * * * *